United States Patent [19]

Nakamura

[11] Patent Number: 4,605,472

[45] Date of Patent: Aug. 12, 1986

[54] DRIVE ASSEMBLY FOR CLEANER FOR WIRE-SCREEN OR FELT-BLANKET BELT OF PAPERMAKING APPARATUS

[76] Inventor: Tooru Nakamura, No. 2263-5, Imaizumi, Fuji City, Shizuoka Prefecture, Japan

[21] Appl. No.: 624,941

[22] Filed: Jun. 27, 1984

[30] Foreign Application Priority Data

Jul. 9, 1983 [JP] Japan ..... 58-124976

[51] Int. Cl.[4] ..... D21F 1/32

[52] U.S. Cl. ..... 162/277; 134/122 R; 162/199; 239/186

[58] Field of Search ..... 162/277, 199; 134/15, 134/122 R; 239/186

[56] References Cited

U.S. PATENT DOCUMENTS

| | | | |
|---|---|---|---|
| 1,459,161 | 6/1923 | Roberts | 162/277 |
| 1,507,608 | 9/1924 | Kidd | 162/277 |
| 1,771,355 | 7/1930 | Scofield | 162/277 |

FOREIGN PATENT DOCUMENTS

| | | | |
|---|---|---|---|
| 824762 | 2/1938 | France | 162/277 |

*Primary Examiner*—Peter Chin

*Attorney, Agent, or Firm*—Martin Smolowitz

[57] ABSTRACT

A cleaner drive assembly used for driving a belt cleaning device such as a shower pipe unit provided in a papermaking apparatus having a sheet forming station including an endless belt to forwardly carry a wet web of paper thereon, the belt cleaning device being used to clean the endless belt by applying streams of liquid to the belt and being movable in opposite directions substantially parallel with the direction of width of the belt. The cleaner drive assembly is adapted to drive the belt cleaning device alternately in the aforesaid opposite directions and comprises a drive unit to produce rotary motions in alternately opposite directions, a rotary-to-axial motion converting unit to convert the rotary motions into reciprocating axial motions, the directions of the reciprocating axial motions being aligned with the opposite directions in which the belt cleaning device is movable. The rotary-to-axial motion converting unit is in driving engagement with the belt cleaning device for transmitting the reciprocating axial motions to the belt cleaning device.

19 Claims, 5 Drawing Figures

DRIVE ASSEMBLY FOR CLEANER FOR WIRE-SCREEN OR FELT-BLANKET BELT OF PAPERMAKING APPARATUS

FIELD OF THE INVENTION

The present invention relates to papermaking apparatus particularly of the type using an endless wire-screen or felt-blanket belt and a belt cleaner provided in the sheet forming station of the papermaking apparatus. More specifically, the present invention is concerned with a cleaner drive assembly for driving the belt cleaner of such a papermaking apparatus.

BACKGROUND OF THE INVENTION

A papermaking apparatus is known which uses a finely-woven endless wire-screen and an endless felt-blanket belt provided in the sheet forming station of the papermaking apparatus. The wire-screen and felt-blanket belts provided in the sheet forming station of the papermaking apparatus are followed by a drying station and carry a wet web of paper toward the drying station during operation of the apparatus. The wire-screen and felt-blanket belts are thus subject to contamination with the wet web of paper being conveyed thereon and are for this reason provided with cleaning means to wash or rinse the belts while the belts are travelling with the wet web of paper carried thereon. Typical of such cleaning means are a vaned rotary felt whipper or beater, a felt conditioner and a shower pipe assembly as is well known in the art. The felt whipper or beat is provided with rotary vanes to beaten a felt-blanket belt to purge the dirt out of the blanket. The felt conditioner uses water ejection heads slidable on a guide bar extending in parallel with the direction of width of the felt-blanket belt and is adapted to spray hot water against the felt-blanket belt to clean the belt. On the other hand, the shower pipe assembly includes a hollow cylindrical water distribution pipe provided with a series of water ejection nozzles which project from the pipe and which are arranged at regular intervals in a longitudinal direction of the pipe. Water, hot or of normal temperature, or a mixture of water and a rinsing compound is directed under pressure into the water distribution pipe and is ejected from the individual water ejection nozzles onto the wire-screen or the felt-blanket belt during operation of the papermaking apparatus. The pipe thus arranged extends horizontally below the endless wire-screen or felt-blanket belt in the sheet forming station of the paper-making apparatus and is lengthwise movable in opposite directions parallel with the direction of width of the overlying belt.

A belt cleaner of each of these types, particularly a shower pipe unit, is driven to move back and forth below the wire-screen or felt-blanket belt by a drive unit which uses a cam and cam follower mechanism to dictate the reciprocating motions of the pipe. The use of such a cam and cam follower mechanism inevitably results in interruptions of the reciprocating motions of the pipe at the opposite ends of each stroke of the pipe. The repeated interruptions of the reciprocating motions of the water distribution pipe in turn result in localized cleaning of the wire-screen or felt-blanket belt, so that the belt may fail to be cleaned in some portions and may be cleaned excessively in other portions.

The water or the mixture of water and a rinsing compound used in an ordinary shower pipe unit is pressurized to 10 kgs/cm$^2$ or less. Localized and accordingly excessive application of water streams onto the belt therefore tends to invite early wear of the belt and lessens the service life of the belt, particularly the felt-blanket belt. The use of a cam and cam follower mechanism in a known drive unit for a belt cleaner of a papermaking apparatus thus ultimately results in frequent exchanges of the wire-screen or felt-blanket belt and accordingly in considerable costs for the maintenance and servicing of the sheet forming station of the apparatus. Furthermore, an extremely large amount of water must be used to reduce the areas of the belt which may fail to be cleaned or which may be cleaned insufficiently. Consumption of such a large amount of water necessarily results in high costs for water and power.

Problems are further encountered by a known drive unit for a belt cleaner of a papermaking apparatus. These problems largely result from the increased production speeds of modernized papermaking machines which require belt cleaners to operate faster and at higher efficiencies. The cam and cam follower arrangement of known driving means for a belt cleaner is not capable of coping with such requirements, and is thus responsible for the disproportionately high costs for not only the maintenance and servicing of the sheet forming station but again for the consumption of power and water. These high costs are ultimately reflected by high market prices of paper and paper products.

It is, accordingly, an important object of the present invention to provide an improved cleaner drive assembly for driving a cleaner unit for an endless wire-screen or felt-blanket belt used in the sheet forming station of a papermaking apparatus.

It is another important object of the present invention to provide a cleaner drive assembly which will guarantee the designed service life of the wire-screen or felt-blanket belt to be cleaned by a belt cleaner.

It is still another important object of the present invention to provide a cleaner drive assembly which will enable a belt cleaner for a wire-screen or felt-blanket belt to clean the belt uniformly throughout the external surface thereof.

It is still another important object of the present invention to provide a cleaner drive assembly which is capable driving a belt cleaner without repeated interruptions of the reciprocating motions of the cleaner at the opposite ends of each stroke of the cleaner.

It is still another important object of the present invention to provide a cleaner drive assembly which will enable a belt cleaner to operate at a higher speed competent with the increased production speed of a modernized papermaking apparatus.

It is, yet, still another important object of the present invention to provide an improved cleaner drive assembly adapted to drive the water distribution pipe of a shower pipe unit to clean a wire-screen or felt-blanket belt provided in the sheet forming station of a papermaking apparatus.

SUMMARY OF THE INVENTION

In accordance with the present invention, there is provided, in a papermaking apparatus having a sheet forming station including an endless belt to forwardly carry a wet web of paper thereon and belt cleaning means to clean the endless belt by applying streams of liquid to the belt, the belt cleaning means being movable in opposite directions substantially parallel with the direction of width of the belt, a cleaner drive assembly for driving the belt cleaning means alternately in the aforesaid opposite directions, the cleaner drive assembly comprising a stationary housing; drive means enclosed within the stationary housing and operative to produce rotary motions in alternately opposite directions about an axis fixed with respect to the stationary housing; rotary-to-axial motion converting means enclosed within the stationary housing and operative to convert the aforesaid rotary motions into reciprocating axial motions with respect to the stationary housing, the directions of the reciprocating axial motions being substantially aligned with the aforesaid opposite directions in which the belt cleaning means is movable; and means for providing engagement between the rotary-to-axial motion converting means and the belt cleaning means and for transmitting the reciprocating axial motions to the belt cleaning means.

In a preferred embodiment of a cleaner drive assembly thus constructed and arranged in accordance with the present invention, the drive means comprises an electric motor having an output shaft rotatable about an axis fixed with respect to the stationary housing, a pair of sector-shaped driving bevel gears which are coaxially rotatable with the output shaft of the motor and which are substantially congruent in shape to each other, the driving bevel gears being, when viewed in axial direction of the combination of the gears, substantially symmetric to each other with respect to a diametrical line which passes through the center axis of the motor output shaft, and a driven bevel gear rotatable about an axis fixed with respect to the stationary housing, the sector-shaped driving bevel gears being alternately meshable with the driven bevel gear, the driving bevel gears being in mesh with the driven bevel gear on planes which are parallel with each other on the opposite sides of a plane which passes through the center axis of the driven bevel gear so that the driven bevel gear is driven by the driving bevel gears in alternately opposite directions about the axis of rotation of the driven bevel gear. In this instance, the sector-shaped driving bevel gears are angularly spaced apart from each other about the center axis of the motor output shaft through an angle which corresponds to a first predetermined number of circular pitches on both sides of one radial half of the diametrical line and an angle which corresponds to a second predetermined number of circular pitches on both sides of the other radial half of the diametrical line, when the gears are viewed in the axial direction of the combination thereof.

On the other hand, the rotary-to-axial motion converting means may comprise an elongated, externally threaded screw rod which is held against axial movement with respect to the stationary housing and which is rotatable in opposite directions about the center axis thereof with respect to the stationary housing, the drive means being in driving engagement with the screw rod and being operative to drive the screw rod for rotation about the center axis thereof, and an internally threaded slide member which is axially movable on and along the screw rod with respect to the stationary housing, the slide member being connected to and movable with the belt cleaning means through the aforesaid means for providing engagement between the rotary-to-axial motion converting means and the belt cleaning means.

BRIEF DESCRIPTION OF THE DRAWINGS

The features and advantages of a cleaner drive assembly according to the present invention will be more clearly appreciated from the following description taken in conjunction with the accompanying drawings, in which like reference numerals represent similar or corresponding members, units and structures and in which.

DESCRIPTION OF THE PREFERRED EMBODIMENTS

Figure 1:
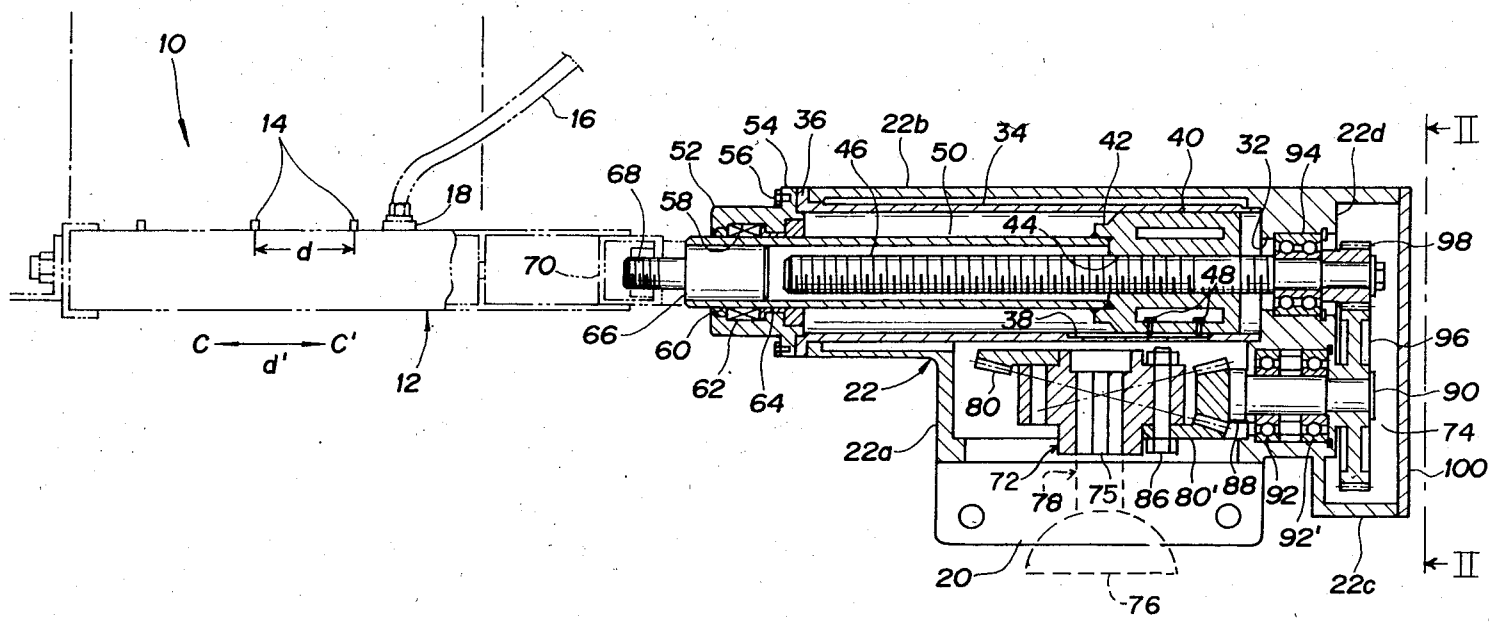
FIG. 1 is a horizontal view showing portions of a shower pipe unit to be provided in the sheet forming station of a papermaking apparatus and the overall construction of a preferred embodiment of a cleaner drive assembly according to the present invention.
Figure 2:
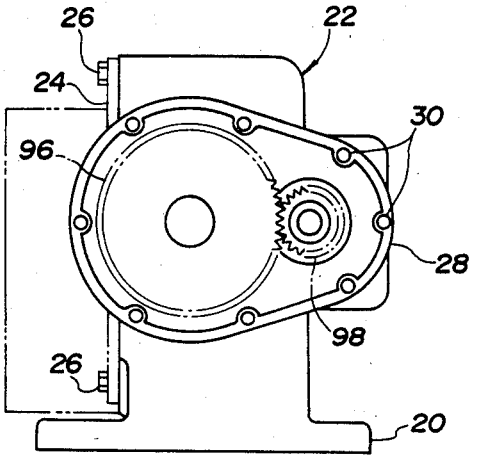
FIG. 2 is a side end view of the cleaner drive assembly viewed from a vertical plane indicated by line II—II in FIG. 1.

Referring to FIGS. 1 and 2 of the drawings, a cleaner drive assembly embodying the present invention is provided in conjunction with a shower pipe unit 10. As is well known in the art of paper production, the shower pipe unit 10 is used to wash a finely-woven endless wire-screen belt or an endless felt-blanket belt provided in a sheet forming station of a papermaking apparatus, though not shown in the drawings. Thus, the shower pipe unit 10 includes a hollow cylindrical water distribution pipe 12 provided with a series of water ejection nozzles 14 which project radially outwardly from the pipe 12, and which are arranged at regular intervals in a longitudinal direction of the pipe 12. In the arrangement herein shown, these water ejection nozzles 14 are secured to the pipe 12 by means of fittings and are assumed to be located at equal spacings from each other as indicated by d. While a cleaning unit herein represented by the shower pipe unit 10 may use hot water, water of normal temperature, or a mixture of water and a rinsing compound, it is assumed that the shower pipe unit 10 uses water of normal temperature for simplicity of description. The water distribution pipe 12 thus communicates with a suitable source of water under pressure through a valved water feed tube 16, connected by fitting 18, so that water under pressure is ejected from the individual water ejection nozzles 14 onto the wire-screen or the felt-blanket belt during operation of the shower pipe unit 10, though not shown in the drawings. The water distribution pipe 12 extends horizontally below the endless wire-screen or felt-blanket belt in the sheet forming station of the paper-making apparatus and usually has a length equal to or not less than the overall width of the overlying wire-screen or the felt-blanket belt or, at least, has a "coverage of movement" not less than the overall width of the wire-screen or felt-blanket belt. Furthermore, the pipe 12 is lengthwise movable back and forth with respect to the stationary frame structure (not shown) of the papermaking apparatus, and may be slidably supported on a suitable support structure (not shown). The water distribution pipe 12 thus constructed and arranged generally is securely coupled at one end thereof to the cleaner drive assembly to which the present invention appertains.

The cleaner drive assembly embodying the present invention is adapted to drive the water distribution pipe 12 to move back and forth longitudinally in a direction parallel with the rolls carrying the endless wire-screen or felt-blanket belt, viz., with the direction of width of the belt. Thus, the cleaner drive assembly comprises drive means enclosed within the stationary housing structure 22 and operative to produce rotary motions in alternately opposite directions about an axis fixed with respect to the stationary housing structure 22.

As shown in FIG. 1, the drive means comprises a stationary base structure 20 and a hollow outer housing structure 22 fixedly supported on and upstanding from the base structure 20. The outer housing structure 22 comprises a lower drive housing portion 22*a* and a generally cylindrical, upper main housing portion 22*b* above the lower motor and gear housing portion 22*a*. The upper main housing portion 22*b* is elongated horizontally and is approximately aligned with the water distribution pipe 12 below the sheet forming station of the papermaking apparatus. The lower drive housing portion 22*a* and the upper main housing portion 22*b* jointly form therein a cavity which is closed by a side wall portion of the housing structure 22 and by a side plate 24 detachably attached to the housing structure 22 by suitable fastening means such as bolts or screws 26 as shown in FIG. 2. The cavity in the upper main housing portion 22*b* is axially open toward the water distribution pipe 12 of the shower pipe unit 10 as shown. The outer housing structure 22 further comprises a gear housing portion 22*c* which is located in part adjacent the drive housing portion 22*a* and in part adjacent the upper main housing portion 22*b*. The gear housing portion 22*c* forms therein a cavity closed by an end plate 28 which is detachably fitted to the gear housing portion 22*c* of the housing structure 22 by suitable fastening means such as bolts or screws 30, as also shown in FIG. 2. The outer housing structure 22 has an internal wall portion 22*d* horizontally intervening between the cavity in the main housing portion 22*b* and the cavity in the gear housing portion 22*c* of the housing structure 22. The internal wall portion 22*d* of the housing structure 22 is formed with an axial bore 32 providing communication between these cavities.

The cleaner drive assembly according to the present invention further comprises rotary-to-axial motion converting means enclosed within the stationary housing structure 22 and operative to convert the aforesaid rotary motions into reciprocating axial motions with respect to the stationary housing structure 22, the directions of the reciprocating axial motions being substantially aligned with the aforesaid opposite directions in which the belt cleaning means is movable.

In FIG. 1, such rotary-to-axial motion converting means is shown comprising a hollow, cylindrical inner casing 34 which is fixedly mounted in the outer housing structure 22. The inner casing 34 extends longitudinally in the upper main housing portion 22*b* of the housing structure 22 toward the water distribution pipe 12 of the shower pipe unit 10. The inner casing 34 has at its axial end closer to the water distribution pipe 12 an annular flange portion 36, which is welded or otherwise securely attached by suitable fastening means (not shown) to the upper main housing portion 22*b* of the outer housing structure 22 at the axially open end of the housing portion 22*b*. The inner casing 34 abuts at the other end thereof to an end face of the internal wall portion 22*d* of the outer housing structure 22 and is also welded or otherwise secured by suitable fastening means (not shown) to the wall portion 22*d*. The bore in the inner casing 34 is thus open at this end of the casing 35 to the above mentioned axial bore 32 in the internal wall portion 22*d* of the housing structure 22. The inner casing 34 has a smooth inner peripheral surface and has in the inner peripheral wall thereof at least one groove 38 extending in axial direction of the casing 34. The axial groove 38 is formed in an end portion of the inner casing 34 opposite to the flange portion 36 and has a length which is predetermined preferably in relation to the spacing d between every adjacent two of the water ejection nozzles 14 on the water distribution pipe 12 of the shower pipe unit 10, as will be described in detail.

The inner casing 34 thus configured has a generally cylindrical internally threaded slide or nut member 40 having a smooth outer peripheral surface received on the inner peripheral surface of casing 34. The nut member 40 is axially slidable on the inner peripheral surface of the inner casing 34 toward and away from the internal wall portion 22*d* of the outer housing structure 22. The nut member 40 has at its axial end opposite to the internal wall portion 22*d* an annular rib portion 42 and is formed with an internally threaded axial bore 44 which is open at the opposite ends of the nut member 40. The nut member 40 has a center axis coincident with the center axis of the inner peripheral surface of the inner casing 34. An elongated, externally threaded drive member or screw rod 46 extends through this internally threaded axial bore 44 in the nut member 40 and has a center axis coincident with the center axis of the nut member 40 and accordingly with the center axis of the inner peripheral surface of the inner casing 34. The threads of the screw rod 46 being in mating engagement with the internal threads of the nut member 40, the members 40 and 46 are rotatable relative to each other about the center axis of the inner peripheral surface of the inner casing 34. The nut member 40 is thus caused to move on and along the elongated screw rod 46 toward and away from the internal wall portion 22*d* of the inner casing 34 as the screw rod 46 is driven for rotation about the center axis thereof. The nut member 40 is held against rotation with respect to the inner casing 34 by means of at least one guide element or pin or, as shown in FIG. 1, two guide elements or pins 48 which project radially from the outer peripheral surface of the nut member 40 into the above mentioned axial groove 38 in the inner casing 34. The pins 48 not only hold the nut member 40 against rotation with respect to the inner casing 34, but serve to limit the distance of axial movement of the nut member 40 with respect to the inner casing 34. The locations of the pins 48 on the nut member 40 and the length of the groove 38 in the inner casing 34 are predetermined so that the nut member 40 is enabled to axially move back and forth a predetermined distance d′ with respect to the casing 34. In the shown embodiment of a cleaner drive assembly according to the present invention, it is assumed, by way of example, that this distance of strokes d′ of the nut member 40 with respect to the casing 34 is substantially equal to the previously mentioned spacing d between every adjacent two of the water ejection nozzles 14 on the water distribution pipe 12 of the shower pipe unit 10, for the reason which will become clear as the description proceeds.

The elongated screw rod 46 axially extends through an elongated connecting sleeve 50 which in part extends axially in the inner casing 34 in alignment with the water distribution pipe 12 of the shower pipe unit 10. The connecting sleeve 50 has one axial end portion welded or otherwise securely attached by suitable fastening means (not shown) to the inner peripheral surface of the annular rib portion 42 of the nut member 40. Another axial end portion of the connecting sleeve 50 projects outwardly from the inner casing 34 toward the water distribution pipe 12 through a plug member 52 having an annular flange portion 54 securely attached to the flange portion 36 of the inner casing 34 by suitable fastening means such as screws 56. The plug member 52 is formed with an axial bore 58 and has received in the bore 58 an annular dust sealing element 60, an annular packing 62 and a flanged metal bushing 64. The connecting sleeve 50 is axially slidable on the inner peripheral surfaces of these sealing element 60, packing 62 and bushing 64. The dust sealing element 60 may be formed of a suitable relatively soft resilient material such as soft rubber and the packing 62 may be formed of a suitable relatively hard resilient material such as hard rubber. The metal bushing 64 may be formed of a suitable copper alloy such as gun metal. The connecting sleeve 50 axially projects from the bore 58 in the plug member 52 toward the water distribution pipe 12 of the shower pipe unit 10. The sleeve 50 and the plug member 52 form part of coupling means to provide connection between the slide member 40 and the water distribution pipe 12 of the shower pipe unit 10. In the embodiment herein shown, such coupling means further comprises a coupling element 66 which is fixedly received in an end portion of the connecting sleeve 50 close to the water distribution pipe 12. The coupling element 66 has a threaded end portion 68 axially projecting toward and in alignment with the pipe 12. The threaded end portion 68 of the coupling element 66 is screwed into a nut 70 fixedly retained in a bracket member which is secured to or forms part of the water distribution pipe 12, as indicated by dots-and dash lines in FIG. 1.

Thus, the rotation of the screw rod 46 about the center axis thereof is converted into axial movement of the internally threaded nut member 40 with respect to the inner casing 34. The axial movement of the internally threaded nut member 40 results in axial movement of the connecting sleeve 50 with respect to the inner casing 34 and, through the coupling element 66, causes the water distribution pipe 12 of the shower pipe unit 10 to move lengthwise with respect to the stationary frame structure (not shown) of the papermaking apparatus, as will be described in more detail.

The screw rod 46 is driven for rotation about the center axis thereof by drive means 72 adapted to alternately produce rotary motions in opposite directions and transmission means 74 adapted to transmit the rotary motions from the drive means 72 to the screw rod 46.

Figure 5:
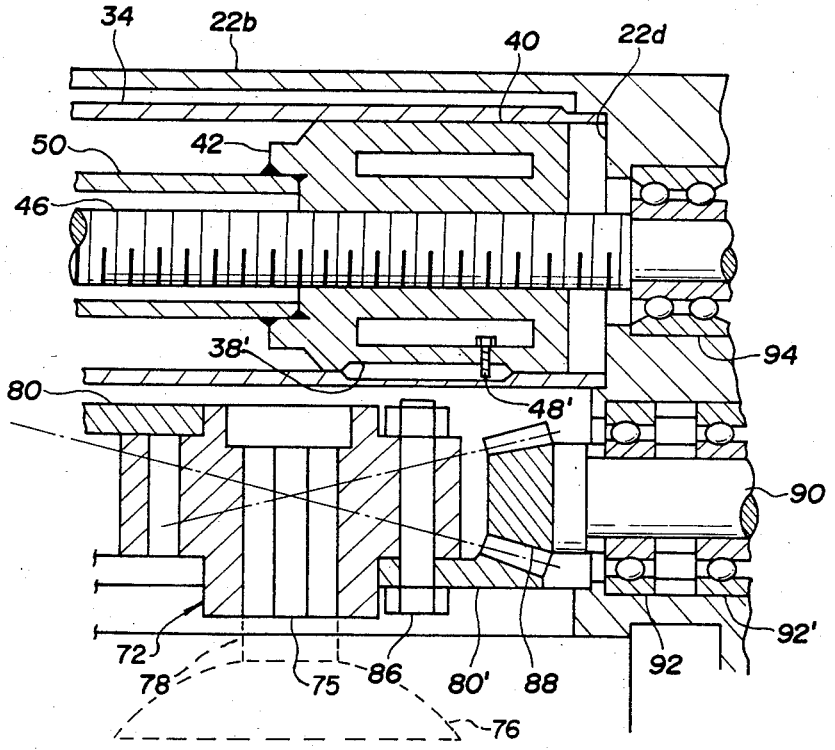
FIG. 5 is a view showing, to an enlarged scale, portions of a modification of the embodiment of a cleaner drive assembly according to the present invention as shown in FIG. 1.
Figure 3:
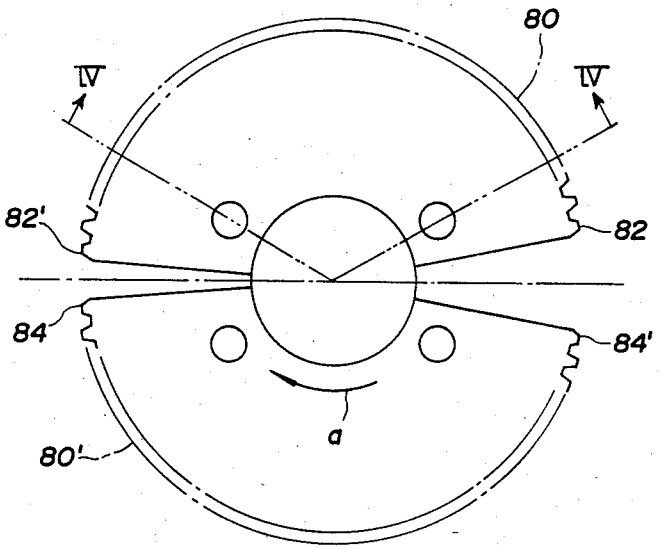
FIG. 3 is a schematic view showing the arrangement of sector-shaped bevel gears which form part of the drive means of the cleaner drive assembly shown in FIG. 1, the gears being viewed in axial direction thereof.

The drive means 72 is accommodated within the drive housing portion **22*a* of the outer housing structure 22 and comprises hub 73 containing bore 75 connected to an electric motor 76 having a horizontally extending output shaft 78. The output shaft 78 of the motor 76 has fixedly carried thereon the hub 73 and a pair of generally semi-circular sector-shaped driving bevel gears 80 and 80' which are shown to enlarged scales in FIGS. 3 and 4 of the drawings. These sector-shaped driving bevel gears 80 and 80' are congruent in shape to each other and are, when viewed in axial direction of the combination of the gears, symmetric to each other with respect to a diametrical line which passes through the center axis of the motor output shaft 78. The two driving bevel gears 80 and 80' are angularly spaced apart from each other about the center axis of the motor output shaft 78 through an angle corresponding to, for example, a single circular pitch on both sides of one radial half of the above mentioned diametrical line and an angle corresponding to, for example, three circular pitches on both sides of the other radial half of the diametrical line, as will be seen from FIG. 3. In general, the two sector-shaped driving bevel gears 80 and 80' of the drive means provided in a cleaner drive assembly according to the present invention are angularly spaced apart about the center axis of the motor output shaft 78 through an angle which corresponds to a first predetermined number of circular pitches on both sides of one radial half of the diametrical line and an angle which corresponds to a second predetermined number of circular pitches on both sides of the other radial half of the diametrical line, when the gears are viewed in the axial direction of the combination thereof. The first and second predetermined number of circular pitches as above mentioned are preferably different from each other but, if desired, may be equal to each other. Furthermore, each of the two driving bevel gears 80 and 80' has, at the opposite extremities of the sector, gear teeth each of which has a reduced addendum, viz., an addendum smaller than the addendum of the remaining gear teeth. In FIG. 3, such reduced addendum gear teeth of the gear 80 are indicated at 82 and 82' and the reduced addendum gear teeth of the gear 80' are indicated at 84 and 84'. The bevel gears 80 and 80' thus configured are mounted on the output shaft 78 of the motor 76 in such a manner that the respective toothed gear faces thereof lie on both sides of a plane perpendicular to the center axis of the motor output shaft 78. In other words, the sector-shaped driving bevel gears 80 and 80' engage the driven bevel gear 88 on planes which are parallel with each other on the opposite sides of a plane which passes through the center axis of the driven bevel gear 88. Thus, one driving bevel gear 80 is positioned on or adjacent one axial end portion of the motor output shaft 78 and the other driving bevel gear 80' is positioned on or adjacent the other axial end portion of the motor output shaft 78, as will be seen from FIG. 1. The gears 80 and 80' are mounted on the motor output shaft 78 by means of, for example, bolts 86 only one of which is shown in FIGS. 1 and 5**.

The sector-shaped driving bevel gears 80 and 80' thus carried on the motor output shaft 78 are alternately meshable with a common driven bevel gear 88 securely mounted or integrally formed on a gear shaft 90. The gear shaft 90 extends within the drive housing portion **22*a* of the outer housing structure 22 perpendicularly to the center axis of the motor output shaft 78 and in parallel with the screw rod 46, and is journaled in two axially spaced bearing units 92 and 92' retained in an axially bored internal wall portion of the outer housing structure 22 which intervenes between the drive and gear housing portions 22*a* and 22*c* of the housing structure 22. During operation of the motor 76, the output shaft 78 of the motor 76 and accordingly the two sector-shaped driving bevel gears 80 and 80' are driven for rotation about the center axis of the shaft 78. The sector-shaped driving bevel gears 80 and 80' are thus alternately, viz., one after the other brought into mesh with the driven bevel gear 88 and drive the driven bevel gear 88 and the gear shaft 90 for rotation in alternately opposite directions about the center axis of the gear shaft 90**.

The output shaft 78 of the motor 76 is herein assumed, by way of example, as being driven for rotation in a direction in which the sector-shaped driving bevel gears 80 and 80' carried on the shaft 78 are caused to turn in a clockwise direction indicated by arrow a in FIG. 3. In this instance, the addendum-reduced gear teeth 82 and 82' of one sector-shaped driving bevel gears 80 as shown are located at the leading and trailing ends, respectively, of the gear 80 and likewise the addendum-reduced gear teeth 84 and 84' of the other sector-shaped driving bevel gears 80' as shown are located at the leading and trailing ends, respectively, of the gear 80'.

Figure 4:
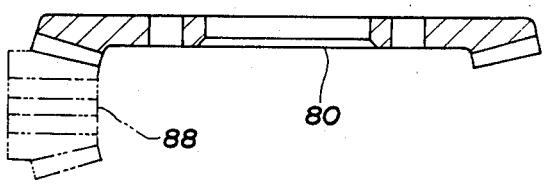
FIG. 4 is a sectional view taken on lines IV—IV in FIG. 3.

As will have been understood from the above description, the drive means 72 provided in a cleaner drive assembly according to the present invention is, thus, adapted to produce rotary motions in alternately opposite directions, which are indicated by arrowheads b and b' in FIG. 4. These rotary motions are transmitted from the gear shaft 90 to the screw rod 46 through the gear means 74 provided in the gear housing portion **22*c* of the outer housing structure 22. The gear shaft 90 carrying the driven bevel gear 88 as above described thus axially projects into the gear housing portion 22*c*. Likewise, the screw rod 46 axially projects into the gear housing portion 22*c* of the outer housing structure 22 and has a journal portion journaled in a bearing unit 94 which is retained in the internal wall portion 22*d* of the outer housing structure 22**.

The gear transmission means 74 of the cleaner drive assembly embodying the present invention comprises at least two spur gears which consists essentially of driving and driven spur gears 96 and 98. The driving and driven spur gears 96 and 98 are securely carried on axial end portions of the gear shaft 90 and the screw rod 46, respectively, and are held in mesh with each other within the gear housing portion **22*c* of the outer housing structure 22. The gear housing portion 22*c* having the driving and driven spur gears 96 and 98 thus accommodated therein is closed by an end plate 100, which is securely yet detachably attached to the housing portion 22*c*** by suitable fastening means (not shown).

The cavities in the housing portions **22*a*, 22*b* and 22*c* of the outer housing structure 22** are preferably filled with oil, so that the gears and all the other movable members can be constantly lubricated.

Description will be hereinafter made in regard to the operation of the cleaner drive assembly thus constructed and arranged in accordance with the present invention. In the description to follow, it will be assumed that the shower pipe unit 10 associated with the cleaner drive assembly is used for the washing of the endless felt-blanket belt provided in the sheet forming station of a papermaking apparatus (not shown). Throughout operation of the papermaking apparatus, the endless felt-blanket belt is moving forwardly along its upper travelling path portion and backwardly along its lower travelling path portion and carries a wet web of paper toward the subsequent drying station of the apparatus, as is well known in the art. Water under pressure is constantly supplied from an external source to the water distribution pipe 12 of the shower pipe unit 10 and is ejected from the water ejection nozzles 14 onto the external surface of the felt-blanket belt from below the blanket, thus washing the blanket which has been contaminated with the wet web of paper.

While water under pressure is being sprayed onto the endless felt-blanket belt as above described, the motor 76 of the drive means 72 in the cleaner drive assembly is in operation driving the output shaft 78 thereof for rotation in the predetermined direction indicated by the arrow a in FIG. 3. The rotation of the motor output shaft 78 is transmitted to the sector-shaped driving bevel gears 80 and 80' on the shaft 78. As the sector-shaped driving bevel gears 80 and 80' are driven for rotation about the center axis of the motor output shaft 78, the reduced-addendum gear tooth 82 at the leading end of one sector-shaped driving bevel gear 80 will be brought into mating engagement with the driven bevel gear 88 and will cause the gear 88 to turn in one direction indicated by the arrowhead b in FIG. 4 about the center axis thereof. Until the driving bevel gear 80 is turned through the central angle thereof about the center axis of the motor output shaft 78, the driven bevel gear 88 is thus driven for rotation in the direction of the arrow b. At a first predetermined interval after the reduced-addendum gear tooth 82' at the trailing end of the gear 80 is disengaged from the driven bevel gear 88, then the reduced-addendum gear tooth 82 at the leading end of the other sector-shaped driving bevel gear 80' is brought into mating engagement with the driven bevel gear 88' and causes the gear 88 to turn in the other direction indicated by the arrowhead b' in FIG. 4 about the center axis thereof. Until the driving bevel gear 80' is turned through the central angle thereof about the center axis of the motor output shaft 78, the driven bevel gear 88 is thus driven for rotation in the direction of the arrow b'. The two driving bevel gears 80 and 80' are thus alternately brought into mesh with the driven bevel gear 88. At a second predetermined interval after the reduced-addendum gear tooth 84' at the trailing end of the gear 80' is disengaged from the driven bevel gear 88, the reduced-addendum gear tooth 82 at the leading end of the sector-shaped driving bevel gear 80 is brought into mating engagement with the driven bevel gear 88 and causes the gear 88 to turn in the direction of the arrowhead b' for a second time. Since the planes on which the sector-shaped driving bevel gears 80 and 80' engage the driven bevel gear 88 are parallel with each other on the opposite sides of a plane which passes through the center axis of the driven bevel gear 88 as previously noted, the bevel gear 88 thus engaged alternately by the two driving bevel gears 80 and 80' is driven for rotation in alternately opposite directions about the center axis thereof. During each of the above mentioned first and second predetermined intervals, there is no driving torque imparted to the driven bevel gear 88 so that the driven bevel gear 88 turns at a decreasing speed. Thus, the driven bevel gear 88 is caused to decelerate after one sector-shaped driving bevel gear 80 is disengaged from the driven bevel gear 88, and to accelerate at an incipient stage after the other sector-shaped driving bevel gear 80' is brought into mesh with the driven bevel gear 88. It will be apparent that the above mentioned first and second predetermined intervals correspond to the angles which are dictated by the previously mentioned first and second predetermined numbers, respectively, of circular pitches of the gears 80 and 80'. The reduced addenda of the gear teeth 82 and 82' at the leading and trailing ends of the driving bevel gear 80 and the reduced addenda of the gear teeth 84 and 84' at the leading end trailing ends of the driving bevel gear 80′ provide smooth engagement and disengagement of the gears 80 and 80 with and from the driven bevel gear 88.

The rotation of the driven bevel gear 88 is transmitted through the gear shaft 90 and further the driving and driven spur gears 96 and 98 forming part of the gear transmission means 74 to the screw rod 46 in the main housing portion 22*a* of the outer housing structure 22. Thus, the screw rod 46 is driven for rotation also in alternately opposite directions about the center axis thereof. As the screw rod 46 is caused to turn in one direction about the center axis thereof, the internally threaded nut member 40 mating with the screw rod 46 is forced to move on and along the screw rod 46 away from the internal wall portion 22*d* of the outer housing structure 22. This axial movement of the nut member 40 results in forward movement of the connecting sleeve 50 with respect to the inner casing 34 and, through the coupling element 66, causes the water distribution pipe 12 of the shower pipe unit 10 to move lengthwise with respect to the stationary frame structure (not shown) of the papermaking apparatus in a direction indicated by arrowhead c in FIG. 1. As the screw rod 46 is caused to turn in the other direction about the center axis thereof, the nut member 40 is forced to move on and along the screw rod 46 toward the internal wall portion 22*d* of the outer housing structure 22 and causes the connecting sleeve 50 to move backwardly with respect to the inner casing 34, and it follows that the water distribution pipe 12 is caused to lengthwise move in a direction indicated by arrowhead c′ in FIG. 1. In these manners, the water distribution pipe 12 of the shower pipe unit 10 is driven to lengthwise move alternately in the directions of the arrows c and c′ as the two sector-shaped driving bevel gears 80 and 80′ are alternately brought into mesh with the driven bevel gear 88.

As previously noted, the pins 48 on the nut member 40 and the groove 38 in the inner casing 34 are arranged so that the nut member 40 is permitted to move back and forth with respect to the inner casing 34 a predetermined distance d′. The water distribution pipe 12 of the shower pipe unit 10 is thus driven to lengthwise move back and forth over the predetermined length d′ with respect to the frame structure of the papermaking apparatus. This distance d′ of strokes of the water distribution pipe 12 is substantially equal to the spacing d between every adjacent two of the water ejection nozzles 14 on the water distribution pipe 12 of the shower pipe unit 10, as also noted previously. Jets of water to be directed at the felt-blanket belt are for this reason produced from the water ejection nozzles 14 throughout the coverage of movement of the water distribution pipe 12.

As above described, furthermore, the driven bevel gear 88 is caused to decelerate after one driving bevel gear 80 is disengaged from the driven bevel gear 88 and to accelerate at an incipient stage after the other driving bevel gear 80′ is brought into mesh with the driven bevel gear 88. By virtue of such rotating motions of the driven bevel gear 88, the water distribution pipe 12 of the shower pipe unit 10 is enabled to slow down as it approaches each of the opposite ends of each stroke thereof and is precluded from being momentarily brought to a stop at each end of each stroke of the pipe 12. Due to such continuity of the reciprocating motions of the water distribution pipe 12 and further because of the fact that the distance of strokes d′ of the pipe 12 is equal to the spacing d between the individual water ejection nozzles 14 on the pipe 12, the wire-screen belt or the felt-blanket belt has no spots or portions which fail to be sprayed with water especially at the ends of the strokes of the pipe 12 and can be washed uniformly throughout the external surface of the belt.

The reciprocating motions of the water distribution pipe 12 of the shower pipe unit 10 originate in the alternate engagement of the two sector-shaped driving bevel gears 80 and 80′ with the driven bevel gear 88. For this reason, the distance of strokes of the water distribution pipe 12 is free from fluctuations which would otherwise result from a lost motion which tends to be caused between any two sliding members such as a cam and a cam follower used in a prior-art cleaner drive unit. Furthermore, the alternate engagement and disengagement of the sector-shaped driving bevel gears 80 and 80′ with and from the driven bevel gear 88 are effected smoothly and for this reason the gears 80, 80′ and 88 are precluded from being damaged by repeated engagement and disengagement, since the gear tooth 82 and 82′ and the gear teeth 84 and 84′ at the leading and trailing ends of the driving bevel gears 80 and 80′ have reduced addenda.

In the embodiment hereinbefore described of a cleaner drive assembly according to the present invention, the arrangement to hold the nut member 40 against rotation with respect to the inner casing 34 and to limit the distance of strokes of the nut member 40 is provided by the groove 38 in the casing 34 and the guide elements 48 on the nut member 40. If desired, such arrangement may be modified so that an axial groove is formed in the nut member 40 with a pin or pins provided on the inner casing 34. FIG. 5 of the drawings shows an embodiment incorporating an example of such a modified arrangement.

Referring to FIG. 5, the nut member 40 has in the outer peripheral wall thereof at least one groove 38′ extending in axial direction of the nut member 40. The axial groove 38′ also has a length which is predetermined preferably in relation to the spacing d between every adjacent two of the water ejection nozzles 14 on the water distribution pipe 12 of the shower pipe unit 10. A guide element or pin 48′ projects radially inwardly from the inner casing 34 into the axial groove 38′ in the nut member 40. The locations of the pin 48 on the inner casing 34 and the length of the groove 38′ in the nut member 40 are predetermined so that the nut member 40 is enabled to axially move back and forth with respect to the casing 34 a predetermined distance d′, which is preferably equal to the spacing d between every adjacent two of the water ejection nozzles 14 on the water distribution pipe 12 of the shower pipe unit 10. The combination of the groove 38′ and the pin 48′ thus serves to hold the nut member 40 against rotation with respect to the inner casing 34 and to limit the distance of axial movement of the nut member 40 with respect to the inner casing 34, and is similar in effect to the combination of the groove 38 and the pin 48 in the embodiment shown in FIG. 1.

While a single preferred embodiment and a single modification thereof have thus far been described and shown, it should be borne in mind that such embodiment and modification are merely illustrative of the gist of the present invention and are not limitative of the spirit and scope of the present invention.

What is claimed is:

1. In a papermaking apparatus having a sheet forming station including an endless belt to forwardly carry a wet web of paper thereon and a shower pipe unit to clean the endless belt by applying streams of liquid to the belt, the shower pipe unit being movable in opposite directions substantially parallel with the direction of width of the belt, a cleaner drive assembly for driving said shower pipe unit alternately in said opposite directions, the cleaner drive assembly comprising:

a stationary housing;

an electric motor having an output shaft rotatable about an axis fixed with respect to said stationary housing;

a pair of sector-shaped driving bevel gears enclosed within said stationary housing and having a common axis of rotation substantially coincident with the axis of rotation of the motor output shaft, the driving bevel gears being substantially congruent in shape to each other about said common axis of rotation thereof and being, when viewed in axial direction of the combination of the gears, substantially symmetric to each other with respect to a diametrical line which passes through said common axis of rotation of the driving bevel gears, said motor output shaft being held in driving engagement with each of said driving bevel gears;

a driven bevel gear having an axis of rotation fixed with respect to said stationary housing and engageable with each of said driving bevel gears on planes which are parallel with each other on the opposite sides of a plane which passes through the axis of rotation of the driven bevel gear, said sector-shaped driving bevel gears being alternately meshable with the driven bevel gear to produce rotary motions in alternately opposite directions about the axis of rotation of the driven bevel gear;

an elongated, externally threaded screw rod which is held against axial movement with respect to said stationary housing and which is rotatable in opposite directions about the center axis thereof with respect to the stationary housing;

intermediate gears intervening between said driven bevel gear and said screw rod and operative to transmit rotation from the driven bevel gear to the screw rod; and an internally threaded slide member engaging said screw rod and held against rotation about the center axis of the screw rod with respect to said housing structure, the slide member being axially movable in alternately opposite directions on and along the screw rod with respect to the stationary housing as the screw rod is driven for rotation about the center axis thereof with respect to said housing structure, the alternately opposite directions of movement of the slide member being respectively in correspondence with said alternatively opposite directions of rotation of said driven bevel gear, said slide member being connected to and movable with said shower pipe unit for driving the shower pipe unit alternately in said opposite directions thereof.

2. A cleaner drive assembly as set forth in claim 1, in which said sector-shaped driving bevel gears are angularly spaced apart from each other about said common axis of rotation of the driving bevel gears through an angle which corresponds to a first predetermined number of circular pitches on both sides of one radial half of the diametrical line and an angle which corresponds to a second predetermined number of circular pitches on both sides of the other radial half of the diametrical line, when the gears are viewed in the axial direction of the combination thereof.

3. A cleaner drive assembly as set forth in claim 2, in which each of said sector-shaped driving bevel gears has, at the opposite extremities of the sector, gear teeth each of which has a reduced addendum.

4. A cleaner drive assembly as set forth in claim 2, in which said first and second predetermined numbers of circular pitches are different from each other.

5. A cleaner drive assembly as set forth in claim 2, in which said first and second predetermined numbers of circular pitches are equal to each other.

6. A cleaner drive assembly as set forth in claim 1, in which the direction of axial movement of said slide member is substantially aligned with the direction in which said shower pipe unit is movable.

7. A cleaner drive assembly as set forth in claim 1, further comprising means for limiting the distance of axial movement of said slide member with respect to said stationary housing.

8. A cleaner drive assembly as set forth in claim 1, further comprising means for holding said slide member against rotation with respect to said stationary housing.

9. A cleaner drive assembly as set forth in claim 1, further comprising a hollow, elongated inner casing enclosed within and fixedly connected to said stationary housing and enclosing said slide member therein, said slide member being slidably received on an inner surface of the inner casing, a portion of one of said slide member and said inner casing being formed with at least one groove which is elongated in parallel with the direction of axial movement of the slide member, and at least one guide element projecting from the other of said slide member and said inner casing into said groove for limiting the distance of axial movement of said slide member with respect to said inner casing and holding said slide member against rotation with respect to the inner casing.

10. A cleaner drive assembly as set forth in claim 9, in which each of said slide member and said inner casing has a substantially circular cross section, wherein said groove is formed in an inner peripheral wall of said inner casing and said guide element projects radially outwardly from an outer peripheral wall of said slide member.

11. A cleaner drive assembly as set forth in claim 9, in which each of said slide member and said inner casing has a substantially circular cross section, wherein said groove is formed in an outer peripheral wall of said slide member and said guide element projects radially outwardly from an inner peripheral wall of said inner casing.

12. A clearner drive assembly as set forth in claim 1, in which said shower pipe unit includes an elongated liquid distribution pipe conmunicable with a source of liquid to wash said endless belt and a plurality of liquid ejection nozzles fixedly mounted on the liquid distribution pipe and arranged at predetermined spacings from each other longitudinally of the pipe, said cleaner drive assembly further comprising means for limiting the distance of axial movement of said slide member with respect to said stationary housing, said distance of axial movement being substantially equal to said spacings.

13. A cleaner drive assembly as set forth in claim 1, further comprising an elongated connecting sleeve in part axially extending in said inner casing and in part projecting outwardly from the inner casing toward said liquid distribution pipe of said shower pipe unit, the connecting sleeve being securely connected at one axial end thereof to said slide member and at the other axial end thereof to said shower pipe unit, said screw rod axially extending in part said connecting sleeve.

14. A cleaner drive assembly as set forth in claim 1, in which said intermediate gears comprise at least two gears one of which is rotatable with said driven bevel gear and the other of which is rotatable with said screw rod.

15. A cleaner drive assembly as set forth in claim 14, in which said driven bevel gear has an axis of rotation substantially parallel with the axis of rotation of said screw rod.

16. A cleaner drive assembly as set forth in claim 3, in which said first and second predetermined numbers of circular pitches are different from each other.

17. A cleaner drive assembly as set forth in claim 3, in which said first and second predetermined numbers of circular pitches are equal from each other.

18. A cleaner drive assembly as set forth in claim 1, in which the common axis of said driving bevel gears is substantially perpendicular in intersecting relationship to said directions of said reciprocating axial motions.

19. A cleaner drive assembly as set forth in claim 1, in which the common axis of said driving bevel gears is substantially perpendicular in non-intersecting relationship to said directions of said reciprocating axial motions.

* * * * *